US010047450B2

(12) United States Patent
Marlot Doerr et al.

(10) Patent No.: US 10,047,450 B2
(45) Date of Patent: Aug. 14, 2018

(54) SELF-LUBRICATING COMPOSITE COATING

(71) Applicant: The Swatch Group Research and Development Ltd, Marin (CH)

(72) Inventors: Agnes Marlot Doerr, Neuchatel (CH); Stewes Bourban, Chabrey (CH); Brice Drieux, Bergerac (FR)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/517,301

(22) PCT Filed: Oct. 5, 2015

(86) PCT No.: PCT/EP2015/072927
§ 371 (c)(1),
(2) Date: Apr. 6, 2017

(87) PCT Pub. No.: WO2016/055409
PCT Pub. Date: Apr. 14, 2016

(65) Prior Publication Data

US 2017/0298528 A1 Oct. 19, 2017

(30) Foreign Application Priority Data

Oct. 8, 2014 (EP) ..... 14188163

(51) Int. Cl.
*C25D 7/00* (2006.01)
*G04B 31/08* (2006.01)
(Continued)

(52) U.S. Cl.
CPC ..... *C25D 7/005* (2013.01); *C10M 103/04* (2013.01); *C10M 125/02* (2013.01); *C25D 3/12* (2013.01);
(Continued)

(58) Field of Classification Search
CPC . C25D 7/005; C25D 3/12; C25D 5/50; C25D 15/00; C10M 103/04;
(Continued)

(56) References Cited

U.S. PATENT DOCUMENTS

2007/0281176 A1 12/2007 Palumbo et al.
2008/0107805 A1 5/2008 Palumbo et al.
(Continued)

FOREIGN PATENT DOCUMENTS

CN 1786292 A 6/2006
CN 101192045 A 6/2008
(Continued)

OTHER PUBLICATIONS

International Preliminary Report on Patentability dated Apr. 3, 2017 in PCT/EP2015/072927 (submitting English translation only).
(Continued)

*Primary Examiner* — James Goloboy
(74) *Attorney, Agent, or Firm* — Oblon, McClelland, Maier & Neustadt, L.L.P.

(57) ABSTRACT

A self-lubricating solid composite coating configured for an application to timepiece mechanisms, including particles of graphene and/or graphene oxide distributed in a metal matrix.

13 Claims, 1 Drawing Sheet

(51) Int. Cl.

| | |
|---|---|
| ***C10M 103/04*** | (2006.01) |
| ***C10M 125/02*** | (2006.01) |
| ***C25D 3/12*** | (2006.01) |
| ***C25D 5/50*** | (2006.01) |
| ***C25D 15/00*** | (2006.01) |

(52) U.S. Cl.
CPC ..... *C25D 5/50* (2013.01); *C25D 15/00* (2013.01); *G04B 31/08* (2013.01); *C10M 2201/041* (2013.01); *C10M 2201/053* (2013.01); *C10N 2240/06* (2013.01)

(58) Field of Classification Search
CPC ..... C10M 125/02; C10M 2201/041; C10M 2201/053; C10N 2240/06; G04B 31/08
See application file for complete search history.

(56) References Cited

U.S. PATENT DOCUMENTS

| | | | | |
|---|---|---|---|---|
| 2008/0123475 | A1* | 5/2008 | Fujimori | C25D 15/02 368/322 |
| 2010/0028714 | A1 | 2/2010 | Palumbo et al. | |
| 2011/0014488 | A1 | 1/2011 | Palumbo et al. | |
| 2011/0024299 | A1 | 2/2011 | Reusmann | |
| 2011/0100825 | A1 | 5/2011 | Heinrichsdorff et al. | |
| 2011/0143159 | A1 | 6/2011 | Palumbo et al. | |
| 2012/0121923 | A1 | 5/2012 | Palumbo et al. | |
| 2016/0083666 | A1* | 3/2016 | Rahoui | B05D 5/08 428/336 |
| 2016/0177959 | A1* | 6/2016 | Marya | F04D 29/026 415/177 |

FOREIGN PATENT DOCUMENTS

| | | | |
|---|---|---|---|
| DE | 10 2008 030 988 | A1 | 12/2009 |
| EP | 2 280 095 | A2 | 2/2011 |
| WO | 2006/063468 | A1 | 6/2006 |
| WO | 2014/141071 | A1 | 9/2014 |

OTHER PUBLICATIONS

International Search Report dated Nov. 24, 2015 in PCT/EP2015/072927 filed Oct. 5, 2015.

* cited by examiner

SELF-LUBRICATING COMPOSITE COATING

CROSS-REFERENCE TO RELATED APPLICATIONS

This is a National phase application in the United States of International patent application PCT/EP2015/072927 filed Oct. 5, 2015 which claims priority on European patent application 14188163.1 filed Oct. 8, 2014. The entire disclosures of the above patent applications are hereby incorporated herein by reference.

The invention relates to a solid self-lubricating composite coating in particular for an application to timepiece mechanisms.

There are numerous moving parts in frictional contact with one another in timepiece mechanisms. These instances of friction must be reduced as far as possible since they can affect the precision and/or autonomy of the mechanism.

In fact, instances of friction cause wear of the parts, an increase in the consumption of energy for moving the parts and a slowing down of the movement.

It is therefore known to use liquid lubricants (oils) or paste lubricants (greases). These lubricants are used sparingly on well defined zones in appropriate quantities. This type of lubricant must be capable of sliding between two parts to minimise the friction or must be deposited during assembly. An adverse effect of the ability to slide between two parts is that it can also slip away from the space where it has been deposited. Moreover, it is very sensitive to ambient conditions of temperature and relative humidity since its viscosity changes in accordance with these.

Therefore, two disadvantages are noted:

- these liquid or viscous lubricants change in the sense that they degrade, e.g. by becoming laden with dusts or becoming more viscous or losing their lubricating abilities by oxidation;
- since this type of lubricant is liquid or in paste form, the movement of the parts tends to shift the lubricant from the zone of contact towards a zone that is not subject to friction.

It is therefore necessary to regularly conduct a maintenance operation that consists of cleaning the parts subject to friction and replacing the used lubricant with new lubricant at the appropriate locations.

These lubricants are formed by a liquid or viscous base that may contain particles with tribological properties such as carbon. Document WO 2012/128714, for example, describes a liquid containing graphene. Graphene was isolated in 2004 by André Geim. This is a two-dimensional carbon crystal, which when stacked leads to graphite. It appears to have interesting tribological properties.

Dry coatings that reduce friction are known besides liquid or viscous lubricants. These coatings are integral to the part to be protected and are less at risk of loss or chemical degradation. Moreover, these coatings are less sensitive to ambient conditions. For example, coatings based on carbon nanotubes dispersed in a nickel matrix are known. Such coatings are described, for example, in document US-A-2008 1323475.

In document WO 2013/150028 the coating metal is gold, but this coating results from a bath containing a percentage of cadmium that is much higher than the percentage allowed by European directives, and this poses problems.

Graphite is also used as an anti-wear agent in electroplated composite coatings.

The difficulty with timepieces is that the needs are very different from the needs of the field of general mechanics, in particular as the thickness of the coating must be limited because of the small dimensions of the timepiece components. Therefore, the coatings sought must be thin and very effective.

For this purpose, the invention relates to a solid composite metal coating having self-lubricating properties, characterised in that it comprises particles of graphene and/or graphene oxide distributed in a metal matrix.

The invention will be more clearly understood with the assistance of the following description provided as a non-restrictive example relating to the drawing, wherein.

Figure 1:
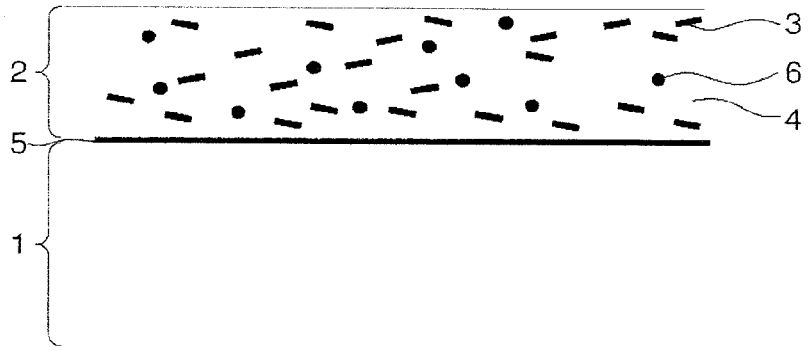
FIG. 1 is a schematic sectional view of the substrate coated with the composite metal graphene.

The drawing shows a sectional view of a support 1 from a timepiece mechanism coated with a solid self-lubricating composite metal coating 2 according to the invention.

This coating 2 comprises particles 3 of graphene and/or graphene oxide distributed in a metal matrix 4.

Particles 3 of graphene or graphene oxide in the form of fibres or flakes (fibre or particle aggregates) are preferably used.

The thickness of this coating is generally in the range of between 0.2 microns and 20 microns, but is preferably in the range of between 0.5 microns and 2 microns.

In some cases, an attachment layer 5 is deposited onto the support 1 before depositing the coating. This layer is formed, for example, from nickel or chromium-gold or gold.

The deposition of the coating is conducted by electroplating if the part to be coated is conductive. If it is a non-conductive part, a purely chemical process will be performed, e.g. a so-called "electroless" process using an oxidising agent (the metal cation or cations), a reducing agent and a catalyst.

In the case of the electroplating process a bath containing metal ions and particles of graphene and/or graphene oxide is used, in which the object to be coated is dipped, wherein the latter forms the cathode in a traditional assembly for electrochemical bath deposition.

In addition to the particles of graphene and/or graphene oxide, this bath can contain other types of particles 6 such as particles of aluminium, boron nitride, tungsten carbide, diamond molybdenum bisulphide, PTFE and/or silicon in pure form, carbide, nitride or oxide, and indeed encapsulated oil droplets (e.g. fluorinated oil), including a mixture of these. If necessary, metal ions can be bound to complexing agents well known in electrochemical processes such as cyanide in the case of a gold bath. The pH of the bath could be adapted with buffering agents to a value fixed in accordance with the chemistry of the bath, e.g. with boric acid in a nickel bath buffered to acid pH values.

If necessary, the bath can also contain additives that are well known in electrochemical processes such as e.g. levelling agents, brighteners and reducing agents.

For a good distribution of the particles in the bath this can also contain surfactants, which bind to the abovementioned particles, surround them and prevent solution agglomeration thereof.

To prevent sedimentation of the particles and encourage an even and homogeneous deposit, the bath will be subjected to a mechanical and/or ultrasonic agitation in order to distribute the different components in the best way.

If a chemical deposition process is used (on non-conductive parts), the composite coating is formed following the same principles: addition of particles 3 and 6 to the bath with surfactant and co-deposition of the particles 3 and 6 with the metal 4 onto the object to be coated with mechanical and/or ultrasonic agitation of the bath.

The deposited metal can be a pure metal such as pure nickel or a metal alloy such as nickel with phosphorus or an alloy of copper, tin and zinc (bronze). The choice of metallic material depends on the respective desired result. For example, nickel phosphorus will enable a coating to be obtained that has non-magnetic properties and bronze will enable a decorative coating to be obtained. It is also possible to deposit ions of gold and/or copper with the graphene or graphene oxide to provide a coating with a gold or copper-gold base matrix. Other metal ions that can also be used for producing this base matrix are, for example, ions of noble metals such as palladium or platinum ions.

For example, the particles of graphene or graphene oxide can be co-deposited on nickel and phosphorus in a bath containing nickel (III) ions and phosphorous acid. Another example would be the co-deposition of graphene or graphene oxide in the presence of gold and copper ions. It will be noted that if graphene oxide is used in the bath, it can be co-reduced during the electrochemical deposition process and can be converted into reduced graphene oxide.

If other particles 6 are contained in the bath, these are co-deposited at the same time as the particles of graphene or graphene oxide 3 in the metal matrix 4.

After the deposition of these various components it is possible to conduct a thermal curing treatment to improve the homogeneity of the deposited layer and/or optimise mechanical properties such as hardness, for example.

Likewise after deposition of the coating 2, it is possible to perform a fine polishing of the coating in order to reduce its roughness.

Figure 3:
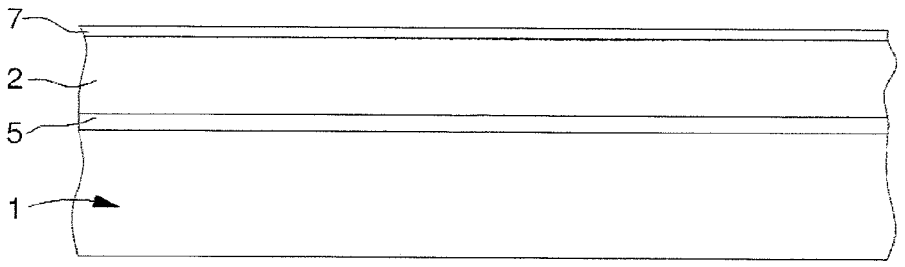
FIG. 3 is a sectional view of a support additionally coated with a gold layer.

Likewise, a deposit 7 of gold with a thickness of 5 to 100 nm (nanometers) could be performed by a galvanic process or other methods (vapour phase deposition or by cathodic sputtering) over the coating deposited electrochemically or by electroless deposition and after polishing (see FIG. 3).

This fine layer 7 of gold is subjected to frictional forces, which cause the gold to penetrate the surface in the metal matrix containing the graphene and/or graphene oxide.

Such a solid coating is not conceivable with pure graphene, in particular because of the cost of the material and too small a thickness.

The chosen solution enables combination of the effects of the graphene with the metal and the other components. It is possible to choose a coating that has the property of greatly reducing friction by increasing the proportion of graphene or obtain a harder surface, thus limiting the wear, by adding to the graphene hard particles chosen from the group comprising aluminium, diamond, boron nitride, tungsten carbide, including a mixture of these.

Therefore, the interest is to combine in a metal matrix of a particular metal or alloy particles or clusters of graphene combined if necessary with other inorganic or organic particles in order to meet each specific requirement. It is not a matter of a chemical combination but of the presence of various particles distributed in the metal matrix. Moreover, the coating is integral to the timepiece part, and this guarantees longevity and better resistance to ambient conditions.

The deposit of the coating can be limited to the zones that are subjected to friction, and the rest of the part can be masked during this deposition.

As an example of the present invention composite coatings can be described that comprise a metal matrix of nickel, in which agglomerations of graphene or graphene oxide are dispersed.

EXAMPLE 1

The coatings are produced from a bath comprising 150 to 600 g/L of nickel sulphate, 4 g/L to 40 g/L of nickel chloride, 30 g/L to 50 g/L of boric acid and 0.5 g/L to 5 g/L of graphene oxide in powder form. The pH of the bath ranges between 3 and 4 and the temperature of the bath is maintained between 50° and 70° C. The coatings are deposited directly onto timepiece parts applying a flow density of 1 to 20 A/dm$^2$.

EXAMPLE 2

Another example is that of coatings obtained from a bath comprising 60 to 150 g/L of nickel in the form of nickel sulphate, 5 g/L to 30 g/L of phosphorus acid, 30 g/L to 50 g/L of boric acid and 0.1 g/L to 5 g/L of graphene oxide in powder form. At a pH in the range of between 1 and 2 composite coatings based on nickel phosphorus and graphene oxide can be obtained applying a flow density of between 0.5 and 10 A/dm$^2$ and more particularly between 1 and 5 A/dm$^2$. Coatings formed in this way lead to performances such as those described in FIG. 2 (curve (a)) with thicknesses in the range of between 0.5 and 5 microns.

Figure 2:
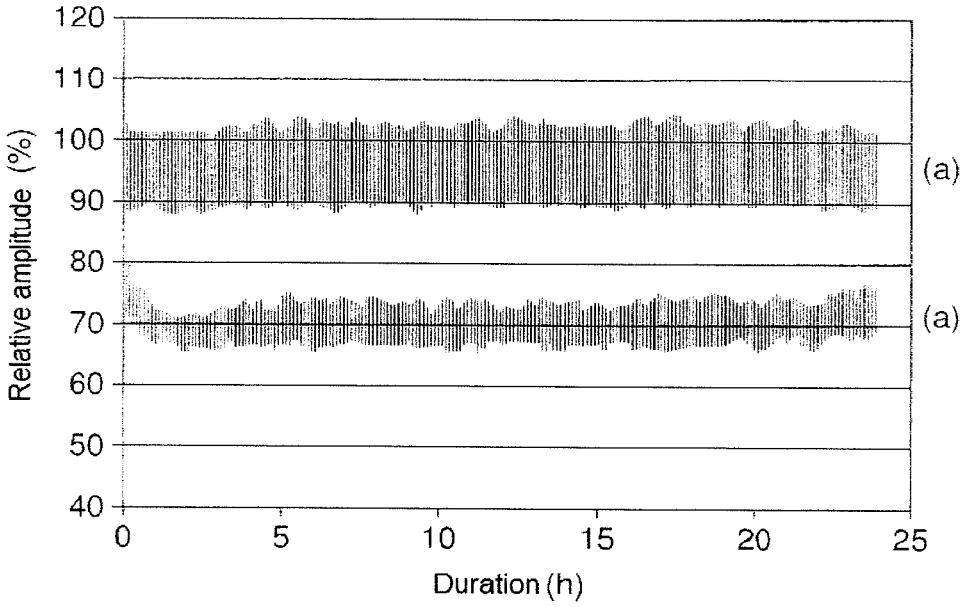
FIG. 2 shows the variation in relative amplitude of a timepiece mechanism with a coating according to the invention (a) and without a coating (b) in relation to a timepiece mechanism lubricated with oil.

FIG. 2 shows the variations in relative oscillation amplitude of a balance of a timepiece movement over a duration of 24 hours.

Curve (a) corresponds to the relation in percentage between the oscillation amplitude value of the balance of a standard movement with an escape wheel provided with a coating according to the invention divided by the oscillation amplitude value of the balance of the same type of movement provided with an escapement (teeth of the escape wheel and lever pallet stones) lubricated according to the prior art.

Curve (b) corresponds to the relation in percentage between the oscillation amplitude value of a balance with an escape wheel and lever pallet stones without coating and without lubrication divided by the oscillation amplitude value of the escapement (teeth of the escape wheel and lever pallet stones) lubricated according to the prior art.

It is understood that the ability of the coating according to the invention to reduce friction is equivalent to the liquid lubrication used previously (curve (a)). Curve (b) shows that without lubricant there is a reduction in the oscillation amplitude of the balance.

The invention claimed is:

1. A timepiece mechanism comprising:

a timepiece comprising a solid self-lubricating composite coating, comprising particles of graphene and/or graphene oxide distributed in a metal matrix, and the graphene and/or graphene oxide is in a form of fibers, particles or aggregates, wherein the aggregates are formed from solid elements, and wherein an attachment layer is deposited prior to formation of the coating.

2. The timepiece according to claim 1, wherein the graphene oxide is reduced graphene oxide.

3. The timepiece according to claim 1, wherein the graphene and/or graphene oxide is bound to metal ions from a pure metal or a metal alloy.

4. The timepiece according to claim 3, wherein the solid coating has undergone a thermal curing treatment.

5. The timepiece according to claim 3, wherein the coating has a polished or lapped surface.

6. The timepiece according to claim 3, wherein the coating is covered with a 5 to 100 nm film of gold.

7. The timepiece according to claim 3, wherein thickness of the coating ranges between 0.2 microns and 20 microns.

8. The timepiece according to claim 7, wherein the thickness of the coating ranges between 0.5 microns and 2 microns.

9. The timepiece according to claim 3, wherein the coating is deposited electrochemically or chemically, wherein constituents of the coating are in suspension in a bath.

10. The timepiece according to claim 3, further comprising particles chosen from the group of aluminium, diamond, boron nitride, tungsten carbide, silicon in pure form, carbide, nitride or oxide, including a mixture of these.

11. The timepiece according to claim 3, further comprising particles chosen from the group of titanium, molybdenum bisulphite and polytetrafluoroethylene (PTFE), including a mixture of these.

12. The timepiece according to claim 1, wherein the particles distributed in the metal matrix comprise of graphene oxide.

13. A timepiece mechanism comprising:

a timepiece comprising a solid self-lubricating composite coating, comprising particles of graphene and/or graphene oxide distributed in a metal matrix, and the graphene and/or graphene oxide is in a form of fibers, particles or aggregates and the graphene and/or graphene oxide is bound to metal ions from a pure metal or a metal alloy, wherein the aggregates are formed from solid elements, and the coating is covered with a 5 to 100 nm film of gold.

* * * * *